US009722324B2

(12) United States Patent
Ali et al.

(10) Patent No.: US 9,722,324 B2
(45) Date of Patent: Aug. 1, 2017

(54) METHOD AND APPARATUS TO CONTROL MUTUAL COUPLING AND CORRELATION FOR MULTI-ANTENNA APPLICATIONS

(75) Inventors: Shirook M. Ali, Milton (CA); James Paul Warden, Fort Worth, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 234 days.

(21) Appl. No.: 14/005,214

(22) PCT Filed: May 31, 2011

(86) PCT No.: PCT/US2011/038543
§ 371 (c)(1),
(2), (4) Date: Sep. 13, 2013

(87) PCT Pub. No.: WO2012/125176
PCT Pub. Date: Sep. 20, 2012

(65) Prior Publication Data

US 2014/0002323 A1 Jan. 2, 2014

Related U.S. Application Data

(60) Provisional application No. 61/452,723, filed on Mar. 15, 2011.

(51) Int. Cl.
*H01Q 21/28* (2006.01)
*H01Q 1/52* (2006.01)

(52) U.S. Cl.
CPC ..... *H01Q 21/28* (2013.01); *H01Q 1/523* (2013.01)

(58) Field of Classification Search
CPC ..... H01Q 21/28; H01Q 1/523
(Continued)

(56) References Cited

U.S. PATENT DOCUMENTS 3,710,281 A * 1/1973 Thomas ..... H01P 1/213 333/134
7,688,273 B2 * 3/2010 Montgomery ..... H01Q 1/243 343/820

(Continued)

FOREIGN PATENT DOCUMENTS

| | | | |
|---|---|---|---|
| EP | 1687929 | A2 | 8/2006 |
| WO | 2005050896 | A2 | 6/2005 |
| WO | 2010025778 | A1 | 3/2010 |

OTHER PUBLICATIONS

International Preliminary Report on Patentability and Written Opinion mailed on Sep. 17, 2013, in corresponding PCT patent application No. PCT/US2011/038543.

(Continued)

*Primary Examiner* — Dameon E Levi
*Assistant Examiner* — Walter Davis
(74) *Attorney, Agent, or Firm* — Fish & Richardson P.C.

(57) ABSTRACT

The present invention provides a method and apparatus to manipulate the mutual coupling and the correlation between the antennas (502, 504) on the handset (202) without the need to change the physical distance between them or to change their orientation. The manipulation in the mutual coupling and in the correlation is achieved using a circuit that is connected between the antennas' terminals (506, 508) and the terminals (510, 512) of the RF front end/power amplifier (514). This circuit can be fixed or tunable. The coupling control takes place between two transmitting antennas (502, 504) or two receiving antennas (502, 504).

14 Claims, 14 Drawing Sheets

(58) Field of Classification Search
USPC ..... 343/852
See application file for complete search history.

(56) References Cited

U.S. PATENT DOCUMENTS

2006/0229049 A1* 10/2006 Ahonpaa ..... H04B 7/022
455/272
2009/0184879 A1* 7/2009 Derneryd ..... H01Q 1/52
343/853

OTHER PUBLICATIONS

Shin-Chang, Chen et al., "A new high isolation dual-antennas with miniature decoupling network design", Antennas and propagation International Symposium, 2007 IEEE, Piscataway, NJ, USA , Jun. 1, 2007, pp. 3125-3128, XP031169842, D0I:10.1109/APS.2007.4396198 ISBN:978-1-4244-0877-1.

Jorn Weber et al. "Implementation of a miniaturised antenna array with predefined orthogonal radiation patterns," Antennas and Propagation, 2006. EUCAP 2006. First European Conference on, IEEE, Piscataway, NJ,USA, Nov. 6, 2006, pp. 1-5, XP031393108, ISBN:978-92-9092-937-6.

Andresen J.B. et al. ; "Decoupling and Descattering Networks for Antennas", IEEE Transactions on Antennas and Propagation, IEEE Service Center, Piscataway, NJ, US, vol. AP-24, No. 6, Jan. 1, 1976 (Jan. 1, 1976), pp. 841-846, XP009047857, ISSN:0018-926X, D0I:10.1109/TAP.1976.1141437.

International Search Report mailed Nov. 16, 2011, in corresponding PCT patent application No. PCT/US2011/038543.

* cited by examiner

METHOD AND APPARATUS TO CONTROL MUTUAL COUPLING AND CORRELATION FOR MULTI-ANTENNA APPLICATIONS

CROSS REFERENCE TO RELATED APPLICATIONS

This application is a national stage entry of PCT/US2011/038543 filed May 31, 2011, which claims the benefit under 35 U.S.C. §119(e) of U.S. Provisional Application No. 61/452,723, filed Mar. 15, 2011 entitled "Method and Apparatus to Control Mutual Coupling and Correlation for Multi-Antenna Applications." U.S. Provisional Application No. 61/452,723 includes exemplary systems and methods and is incorporated by reference in its entirety.

BACKGROUND OF THE INVENTION

Field of the Invention

The present invention is directed in general to communications systems and methods for operating same. In one aspect, the present invention relates to devices and methods for manipulating the mutual coupling and the correlation between antennas on a handset without the need to change the physical distance between the antennas or to change their orientation.

Description of the Related Art

Future applications require technologies that provide higher throughput with broadband communications. Multiple-antenna technologies have promised system improvement such as to cover the future needs of throughput and bandwidth. In some cases, a limitation in implementing multiple antennas in the handset is the increased coupling that takes place between the antennas as the operating frequency becomes lower and/or as the handset device becomes smaller. The mutual coupling between the antennas also has a negative impact on the correlation between the antennas, which directly translates into an overall system performance degradation.

Researchers have introduced diversity techniques such as spatial diversity, where the antennas are kept apart at the largest distance possible, polarization diversity techniques, where the antennas are designed to have orthogonal polarizations, and pattern diversity techniques, which means that the two antennas have maximums in their patterns that are not in the same direction as well as other diversity techniques. However, these techniques have their limitations, especially for implementation in the confined volume of the handset. Therefore, to realize more benefits of multiple-antenna systems, novel approaches need to be developed to manipulate the mutual coupling and correlation between the antennas on the handset.

BRIEF DESCRIPTION OF THE DRAWINGS

The present invention may be understood, and its numerous objects, features and advantages obtained, when the following detailed description is considered in conjunction with the following drawings, in which.

DETAILED DESCRIPTION

Figure 1:
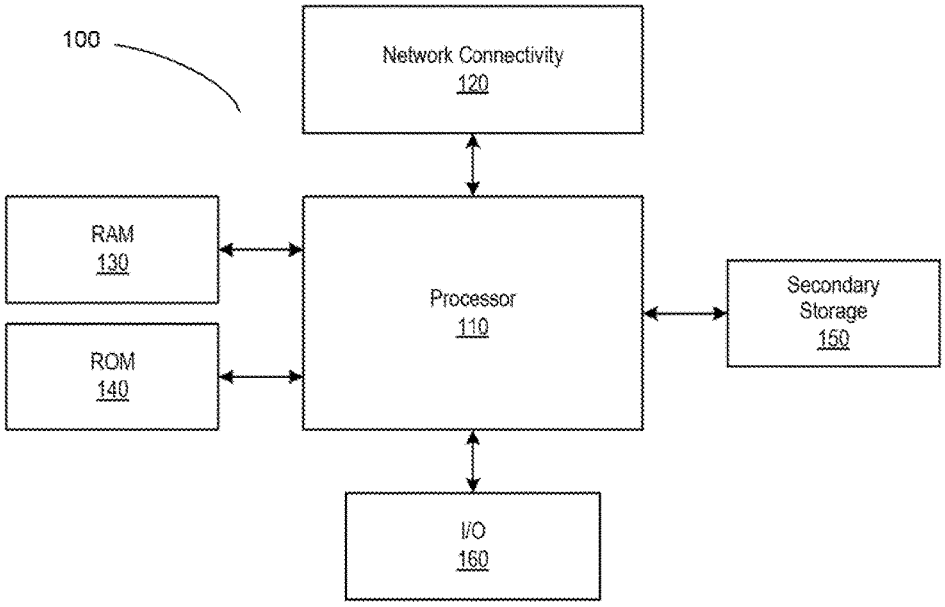
FIG. 1 depicts an exemplary system in which the embodiments of the disclosure may be implemented.

An apparatus and method are provided for manipulating the mutual coupling and the correlation between antennas on a wireless client node without the need to change the physical distance between them or to change their orientation. In various embodiments of the disclosure a client node comprises first and second antennas comprising first and second antenna ports. A mutual coupling compensation circuit is coupled to the first antenna port and is operable to generate a first mutual coupling compensation signal to eliminate a first mutual coupling signal received at the first antenna port in response to a first signal generated by said second antenna. In various embodiments, the mutual coupling compensation circuit is further coupled to the second antenna port and is operable to generate a second mutual coupling compensation signal to eliminate a second mutual coupling signal received at said second antenna port in response to a second signal generated by said first antenna The coupling compensation circuit disclosed herein is configured such that it is not necessary for the antennas or their environment to be symmetric, i.e., the antenna does not need to be of the same type, hence, the single compensated first antenna port does not need to be equal to the signal compensated at the second antenna port. Furthermore, the embodiments of the coupling compensation circuit disclosed herein are not limited to applications where the antennas need to be at least 0.5λ apart. The techniques disclosed herein comprise a post-processing step that can be implemented after the design of the antennas is complete, thereby reducing and simplifying the design cycle of a multi-antenna client node. The compensation circuit can be used between two transmitting antennas and between two receiving antennas.

The techniques disclosed herein can be implemented on a printed circuit board and are independent of the antennas' location, orientation, and placement. Furthermore, the implementation of the devices and methods disclosed herein are flexible, since the compensation connecting circuit can be implemented using lumped elements, transmission lines, or a combination thereof.

Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the inventor's specific goals, such as compliance with process technology or design-related constraints, which will vary from one implementation to another. While such a development effort might be complex and time-consuming, it would nevertheless be a routine undertaking for those of skill in the art having the benefit of this disclosure. For example, selected aspects are shown in block diagram and flowchart form, rather than in detail, in order to avoid limiting or obscuring the present invention. In addition, some portions of the detailed descriptions provided herein are presented in terms of algorithms or operations on data within a computer memory. Such descriptions and representations are used by those skilled in the art to describe and convey the substance of their work to others skilled in the art.

As used herein, the terms "component," "system" and the like are intended to refer to a computer-related entity, either hardware, a combination of hardware and software, software, software in execution. For example, a component may be, but is not limited to being, a process running on a processor, a processor, an object, an executable, a thread of execution, a program, or a computer. By way of illustration, both an application running on a computer and the computer itself can be a component. One or more components may reside within a process or thread of execution and a component may be localized on one computer or distributed between two or more computers.

As likewise used herein, the term "node" broadly refers to a connection point, such as a redistribution point or a communication endpoint, of a communication environment, such as a network. Accordingly, such nodes refer to an active electronic device capable of sending, receiving, or forwarding information over a communications channel. Examples of such nodes include data circuit-terminating equipment (DCE), such as a modem, hub, bridge or switch, and data terminal equipment (DTE), such as a handset, a printer or a host computer (e.g., a router, workstation or server). Examples of local area network (LAN) or wide area network (WAN) nodes include computers, packet switches, cable modems, Data Subscriber Line (DSL) modems, and wireless LAN (WLAN) access points. Examples of Internet or Intranet nodes include host computers identified by an Internet Protocol (IP) address, bridges and WLAN access points. Likewise, examples of nodes in cellular communication include base stations, relays, base station controllers, home location registers, Gateway GPRS Support Nodes (GGSN), and Serving GPRS Support Nodes (SGSN).

Other examples of nodes include client nodes, server nodes, peer nodes and access nodes. As used herein, a client node may refer to wireless devices such as mobile telephones, smart phones, personal digital assistants (PDAs), handheld devices, portable computers, tablet computers, and similar devices or other user equipment (UE) that has telecommunications capabilities. Such client nodes may likewise refer to a mobile, wireless device, or conversely, to devices that have similar capabilities that are not generally transportable, such as desktop computers, set-top boxes, or sensors. Likewise, a server node, as used herein, refers to an information processing device (e.g., a host computer), or series of information processing devices, that perform information processing requests submitted by other nodes. As likewise used herein, a peer node may sometimes serve as client node, and at other times, a server node. In a peer-to-peer or overlay network, a node that actively routes data for other networked devices as well as itself may be referred to as a supernode.

An access node, as used herein, refers to a node that provides a client node access to a communication environment. Examples of access nodes include cellular network base stations and wireless broadband (e.g., WiFi, WiMAX, etc) access points, which provide corresponding cell and WLAN coverage areas. As used herein, a macrocell is used to generally describe a traditional cellular network cell coverage area. Such macrocells are typically found in rural areas, along highways, or in less populated areas. As likewise used herein, a microcell refers to a cellular network cell with a smaller coverage area than that of a macrocell. Such micro cells are typically used in a densely populated urban area. Likewise, as used herein, a picocell refers to a cellular network coverage area that is less than that of a microcell. An example of the coverage area of a picocell may be a large office, a shopping mall, or a train station. A femtocell, as used herein, currently refers to the smallest commonly accepted area of cellular network coverage. As an example, the coverage area of a femtocell is sufficient for homes or small offices.

In general, a coverage area of less than two kilometers typically corresponds to a microcell, 200 meters or less for a picocell, and on the order of 10 meters for a femtocell. As likewise used herein, a client node communicating with an access node associated with a macrocell is referred to as a "macrocell client." Likewise, a client node communicating with an access node associated with a microcell, picocell, or femtocell is respectively referred to as a "microcell client," "picocell client," or "femtocell client."

The term "article of manufacture" (or alternatively, "computer program product") as used herein is intended to encompass a computer program accessible from any computer-readable device or media. For example, computer readable media can include but are not limited to magnetic storage devices (e.g., hard disk, floppy disk, magnetic strips, etc.), optical disks such as a compact disk (CD) or digital versatile disk (DVD), smart cards, and flash memory devices (e.g., card, stick, etc.).

The word "exemplary" is used herein to mean serving as an example, instance, or illustration. Any aspect or design described herein as "exemplary" is not necessarily to be construed as preferred or advantageous over other aspects or designs. Those of skill in the art will recognize many modifications may be made to this configuration without departing from the scope, spirit or intent of the claimed subject matter. Furthermore, the disclosed subject matter may be implemented as a system, method, apparatus, or article of manufacture using standard programming and engineering techniques to produce software, firmware, hardware, or any combination thereof to control a computer or processor-based device to implement aspects detailed herein.

FIG. 1 illustrates an example of a system 100 suitable for implementing one or more embodiments disclosed herein. In various embodiments, the system 100 comprises a processor 110, which may be referred to as a central processor unit (CPU) or digital signal processor (DSP), network connectivity interfaces 120, random access memory (RAM) 130, read only memory (ROM) 140, secondary storage 150, and input/output (I/O) devices 160. In some embodiments, some of these components may not be present or may be combined in various combinations with one another or with other components not shown. These components may be located in a single physical entity or in more than one physical entity. Any actions described herein as being taken by the processor 110 might be taken by the processor 110 alone or by the processor 110 in conjunction with one or more components shown or not shown in FIG. 1.

The processor 110 executes instructions, codes, computer programs, or scripts that it might access from the network connectivity interfaces 120, RAM 130, or ROM 140. While only one processor 110 is shown, multiple processors may be present. Thus, while instructions may be discussed as being executed by a processor 110, the instructions may be executed simultaneously, serially, or otherwise by one or multiple processors 110 implemented as one or more CPU chips.

In various embodiments, the network connectivity interfaces 120 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, long term evolution (LTE) radio transceiver devices, worldwide interoperability for microwave access (WiMAX) devices, and/or other well-known interfaces for connecting to networks, including Personal Area Networks (PANs) such as Bluetooth. These network connectivity interfaces 120 may enable the processor 110 to communicate with the Internet or one or more telecommunications networks or other networks from which the processor 110 might receive information or to which the processor 110 might output information.

The network connectivity interfaces 120 may also be capable of transmitting or receiving data wirelessly in the form of electromagnetic waves, such as radio frequency signals or microwave frequency signals. Information transmitted or received by the network connectivity interfaces 120 may include data that has been processed by the processor 110 or instructions that are to be executed by processor 110. The data may be ordered according to different sequences as may be desirable for either processing or generating the data or transmitting or receiving the data.

In various embodiments, the RAM 130 may be used to store volatile data and instructions that are executed by the processor 110. The ROM 140 shown in FIG. 1 may likewise be used to store instructions and data that is read during execution of the instructions. The secondary storage 150 is typically comprised of one or more disk drives or tape drives and may be used for non-volatile storage of data or as an overflow data storage device if RAM 130 is not large enough to hold all working data. Secondary storage 150 may likewise be used to store programs that are loaded into RAM 130 when such programs are selected for execution. The I/O devices 160 may include liquid crystal displays (LCDs), Light Emitting Diode (LED) displays, Organic Light Emitting Diode (OLED) displays, projectors, televisions, touch screen displays, keyboards, keypads, switches, dials, mice, track balls, voice recognizers, card readers, paper tape readers, printers, video monitors, or other well-known input/output devices.

Figure 2:
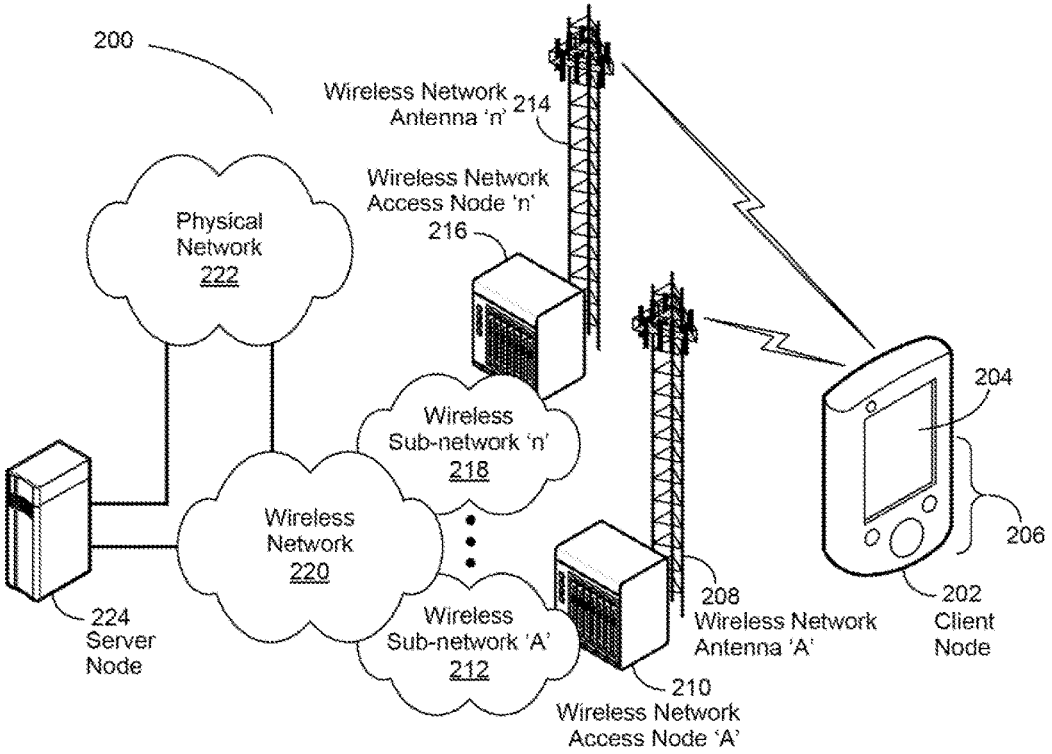
FIG. 2 shows a wireless-enabled communications environment including an embodiment of a client node.

FIG. 2 shows a wireless-enabled communications environment including an embodiment of a client node as implemented in an embodiment of the invention. Though illustrated as a mobile phone, the client node 202 may take various forms including a wireless handset, a pager, a smart phone, or a personal digital assistant (PDA). In various embodiments, the client node 202 may also comprise a portable computer, a tablet computer, a laptop computer, or any computing device operable to perform data communication operations. Many suitable devices combine some or all of these functions. In some embodiments, the client node 202 is not a general purpose computing device like a portable, laptop, or tablet computer, but rather is a special-purpose communications device such as a telecommunications device installed in a vehicle. The client node 202 may likewise be a device, include a device, or be included in a device that has similar capabilities but that is not transportable, such as a desktop computer, a set-top box, or a network node. In these and other embodiments, the client node 202 may support specialized activities such as gaming, inventory control, job control, task management functions, and so forth.

In various embodiments, the client node 202 includes a display 204. In these and other embodiments, the client node 202 may likewise include a touch-sensitive surface, a keyboard or other input keys 206 generally used for input by a user. The input keys 206 may likewise be a full or reduced alphanumeric keyboard such as QWERTY, Dvorak, AZERTY, and sequential keyboard types, or a traditional numeric keypad with alphabet letters associated with a telephone keypad. The input keys 206 may likewise include a trackwheel, an exit or escape key, a trackball, and other navigational or functional keys, which may be inwardly depressed to provide further input function. The client node 202 may likewise present options for the user to select, controls for the user to actuate, and cursors or other indicators for the user to direct.

The client node 202 may further accept data entry from the user, including numbers to dial or various parameter values for configuring the operation of the client node 202. The client node 202 may further execute one or more software or firmware applications in response to user commands. These applications may configure the client node 202 to perform various customized functions in response to user interaction. Additionally, the client node 202 may be programmed or configured over-the-air (OTA), for example from a wireless network access node 'A' 210 through 'n' 216 (e.g., a base station), a server node 224 (e.g., a host computer), or a peer client node 202.

Among the various applications executable by the client node 202 are a web browser, which enables the display 204 to display a web page. The web page may be obtained from a server node 224 through a wireless connection with a wireless network 220. As used herein, a wireless network 220 broadly refers to any network using at least one wireless connection between two of its nodes. The various applications may likewise be obtained from a peer client node 202 or other system over a connection to the wireless network 220 or any other wirelessly-enabled communication network or system.

In various embodiments, the wireless network 220 comprises a plurality of wireless sub-networks (e.g., cells with corresponding coverage areas) 'A' 212 through 'n' 218. As used herein, the wireless sub-networks 'A' 212 through 'n' 218 may variously comprise a mobile wireless access network or a fixed wireless access network. In these and other embodiments, the client node 202 transmits and receives communication signals, which are respectively communicated to and from the wireless network nodes 'A' 210 through 'n' 216 by wireless network antennas 'A' 208 through 'n' 214 (e.g., cell towers). In turn, the communication signals are used by the wireless network access nodes 'A' 210 through 'n' 216 to establish a wireless communication session with the client node 202. As used herein, the network access nodes 'A' 210 through 'n' 216 broadly refer to any access node of a wireless network. As shown in FIG. 2, the wireless network access nodes 'A' 210 through 'n' 216 are respectively coupled to wireless sub-networks 'A' 212 through 'n' 218, which are in turn connected to the wireless network 220.

In various embodiments, the wireless network 220 is coupled to a physical network 222, such as the Internet. Via the wireless network 220 and the physical network 222, the client node 202 has access to information on various hosts, such as the server node 224. In these and other embodiments, the server node 224 may provide content that may be shown on the display 204 or used by the client node processor 110 for its operations. Alternatively, the client node 202 may access the wireless network 220 through a peer client node 202 acting as an intermediary, in a relay type or hop type of connection. As another alternative, the client node 202 may be tethered and obtain its data from a linked device that is connected to the wireless network 212. Skilled practitioners of the art will recognize that many such embodiments are possible and the foregoing is not intended to limit the spirit, scope, or intention of the disclosure.

Figure 3:
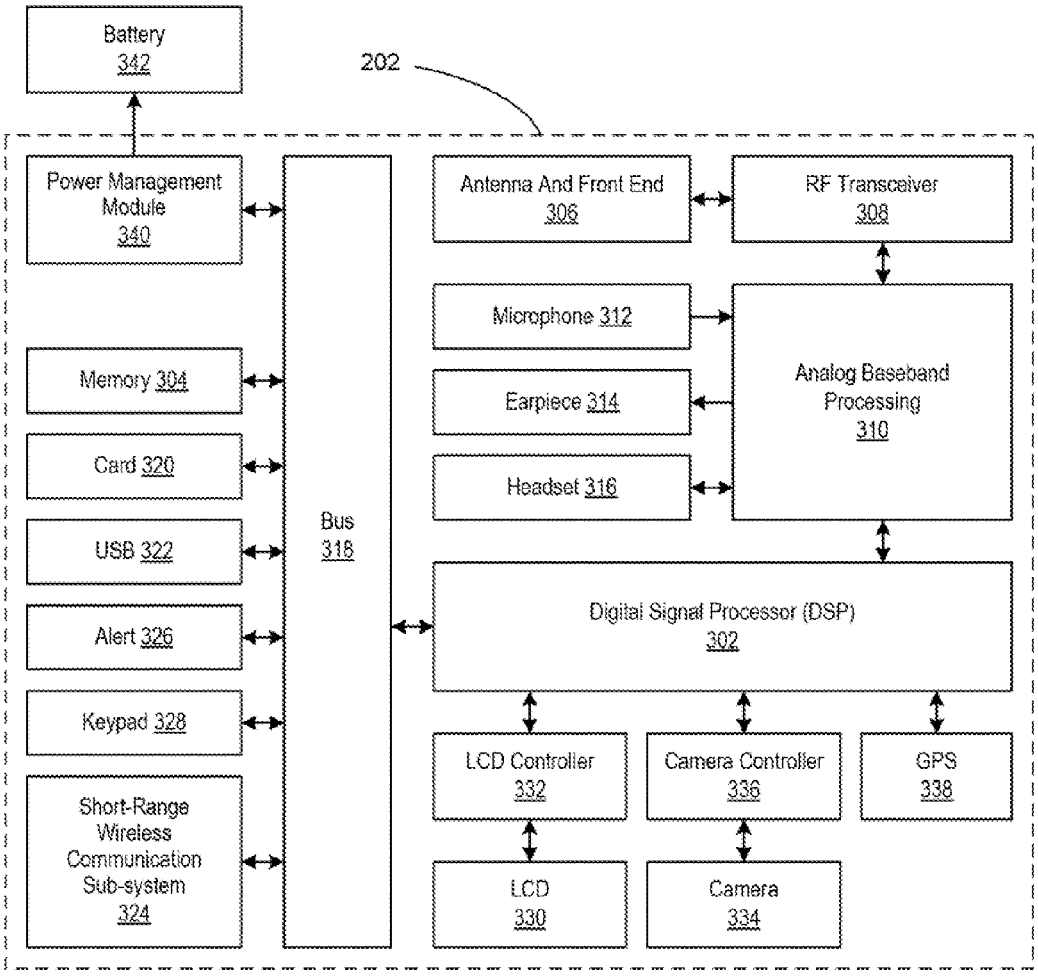
FIG. 3 is a simplified block diagram of an exemplary client node comprising a digital signal processor (DSP)

FIG. 3 depicts a block diagram of an exemplary client node as implemented with a digital signal processor (DSP) in accordance with an embodiment of the invention. While various components of a client node 202 are depicted, various embodiments of the client node 202 may include a subset of the listed components or additional components not listed. As shown in FIG. 3, the client node 202 includes a DSP 302 and a memory 304. As shown, the client node 202 may further include an antenna and front end unit 306, a radio frequency (RF) transceiver 308, an analog baseband processing unit 310, a microphone 312, an earpiece speaker 314, a headset port 316, a bus 318, such as a system bus or an input/output (I/O) interface bus, a removable memory card 320, a universal serial bus (USB) port 322, a short range wireless communication sub-system 324, an alert 326, a keypad 328, a liquid crystal display (LCD) 330, which may include a touch sensitive surface, an LCD controller 332, a charge-coupled device (CCD) camera 334, a camera controller 336, and a global positioning system (GPS) sensor 338, and a power management module 340 operably coupled to a power storage unit, such as a battery 342. In various embodiments, the client node 202 may include another kind of display that does not provide a touch sensitive screen. In one embodiment, the DSP 302 communicates directly with the memory 304 without passing through the input/output interface 318.

In various embodiments, the DSP 302 or some other form of controller or central processing unit (CPU) operates to control the various components of the client node 202 in accordance with embedded software or firmware stored in memory 304 or stored in memory contained within the DSP 302 itself. In addition to the embedded software or firmware, the DSP 302 may execute other applications stored in the memory 304 or made available via information carrier media such as portable data storage media like the removable memory card 320 or via wired or wireless network communications. The application software may comprise a compiled set of machine-readable instructions that configure the DSP 302 to provide the desired functionality, or the application software may be high-level software instructions to be processed by an interpreter or compiler to indirectly configure the DSP 302.

The antenna and front end unit 306 may be provided to convert between wireless signals and electrical signals, enabling the client node 202 to send and receive information from a cellular network or some other available wireless communications network or from a peer client node 202. In an embodiment, the antenna and front end unit 106 may include multiple antennas to support beam forming and/or multiple input multiple output (MIMO) operations. As is known to those skilled in the art, MIMO operations may provide spatial diversity which can be used to overcome difficult channel conditions or to increase channel throughput. Likewise, the antenna and front end unit 306 may include antenna tuning or impedance matching components, RF power amplifiers, or low noise amplifiers.

In various embodiments, the RF transceiver 308 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 310 or the DSP 302 or other central processing unit. In some embodiments, the RF Transceiver 108, portions of the Antenna and Front End 306, and the analog base band processing unit 310 may be combined in one or more processing units and/or application specific integrated circuits (ASICs).

The analog baseband processing unit 310 may provide various analog processing of inputs and outputs, for example analog processing of inputs from the microphone 312 and the headset 316 and outputs to the earpiece 314 and the headset 316. To that end, the analog baseband processing unit 310 may have ports for connecting to the built-in microphone 312 and the earpiece speaker 314 that enable the client node 202 to be used as a cell phone. The analog baseband processing unit 310 may further include a port for connecting to a headset or other hands-free microphone and speaker configuration. The analog baseband processing unit 310 may provide digital-to-analog conversion in one signal direction and analog-to-digital conversion in the opposing signal direction. In various embodiments, at least some of the functionality of the analog baseband processing unit 310 may be provided by digital processing components, for example by the DSP 302 or by other central processing units.

The DSP 302 may perform modulation/demodulation, coding/decoding, interleaving/deinterleaving, spreading/despreading, inverse fast Fourier transforming (IFFT)/fast Fourier transforming (FFT), cyclic prefix appending/removal, and other signal processing functions associated with wireless communications. In an embodiment, for example in a code division multiple access (CDMA) technology application, for a transmitter function the DSP 302 may perform modulation, coding, interleaving, and spreading, and for a receiver function the DSP 302 may perform despreading, deinterleaving, decoding, and demodulation. In another embodiment, for example in an orthogonal frequency division multiplex access (OFDMA) technology application, for the transmitter function the DSP 302 may perform modulation, coding, interleaving, inverse fast Fourier transforming, and cyclic prefix appending, and for a receiver function the DSP 302 may perform cyclic prefix removal, fast Fourier transforming, deinterleaving, decoding, and demodulation. In other wireless technology applications, yet other signal processing functions and combinations of signal processing functions may be performed by the DSP 302.

The DSP 302 may communicate with a wireless network via the analog baseband processing unit 310. In some embodiments, the communication may provide Internet connectivity, enabling a user to gain access to content on the Internet and to send and receive e-mail or text messages. The input/output interface 318 interconnects the DSP 302 and various memories and interfaces. The memory 304 and the removable memory card 320 may provide software and data to configure the operation of the DSP 302. Among the interfaces may be the USB interface 322 and the short range wireless communication sub-system 324. The USB interface 322 may be used to charge the client node 202 and may also enable the client node 202 to function as a peripheral device to exchange information with a personal computer or other computer system. The short range wireless communication sub-system 324 may include an infrared port, a Bluetooth interface, an IEEE 802.11 compliant wireless interface, or any other short range wireless communication sub-system, which may enable the client node 202 to communicate wirelessly with other nearby client nodes and access nodes.

The input/output interface 318 may further connect the DSP 302 to the alert 326 that, when triggered, causes the client node 202 to provide a notice to the user, for example, by ringing, playing a melody, or vibrating. The alert 326 may serve as a mechanism for alerting the user to any of various events such as an incoming call, a new text message, and an appointment reminder by silently vibrating, or by playing a specific pre-assigned melody for a particular caller.

The keypad 328 couples to the DSP 302 via the I/O interface 318 to provide one mechanism for the user to make selections, enter information, and otherwise provide input to the client node 202. The keyboard 328 may be a full or reduced alphanumeric keyboard such as QWERTY, Dvorak, AZERTY and sequential types, or a traditional numeric keypad with alphabet letters associated with a telephone keypad. The input keys may likewise include a trackwheel, an exit or escape key, a trackball, and other navigational or functional keys, which may be inwardly depressed to provide further input function. Another input mechanism may be the LCD 330, which may include touch screen capability and also display text and/or graphics to the user. The LCD controller 332 couples the DSP 302 to the LCD 330.

The CCD camera 334, if equipped, enables the client node 202 to take digital pictures. The DSP 302 communicates with the CCD camera 334 via the camera controller 336. In another embodiment, a camera operating according to a technology other than Charge Coupled Device cameras may be employed. The GPS sensor 338 is coupled to the DSP 302 to decode global positioning system signals or other navigational signals, thereby enabling the client node 202 to determine its position. Various other peripherals may also be included to provide additional functions, such as radio and television reception.

Figure 4:
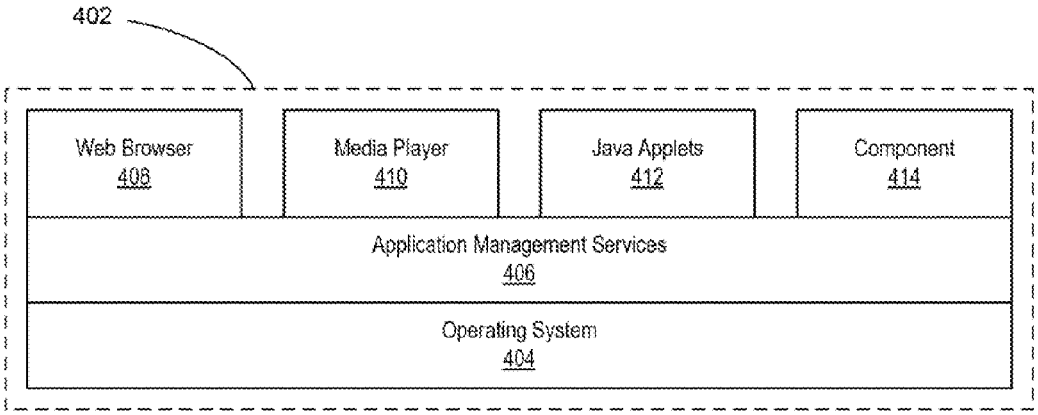
FIG. 4 is a simplified block diagram of a software environment that may be implemented by a DSP.

FIG. 4 illustrates a software environment 402 that may be implemented by a digital signal processor (DSP). In this embodiment, the DSP 302 shown in FIG. 3 executes an operating system 404, which provides a platform from which the rest of the software operates. The operating system 404 likewise provides the client node 202 hardware with standardized interfaces (e.g., drivers) that are accessible to application software. The operating system 404 likewise comprises application management services (AMS) 406 that transfer control between applications running on the client node 202. Also shown in FIG. 4 are a web browser application 408, a media player application 410, and Java applets 412. The web browser application 408 configures the client node 202 to operate as a web browser, allowing a user to enter information into forms and select links to retrieve and view web pages. The media player application 410 configures the client node 202 to retrieve and play audio or audiovisual media. The Java applets 412 configure the client node 202 to provide games, utilities, and other functionality. A component 414 may provide functionality described herein. In various embodiments, the client node 202, the wireless network nodes 'A' 210 through 'n' 216, and the server node 224 shown in FIG. 2 may likewise include a processing component that is capable of executing instructions related to the actions described above.

Figure 5A:
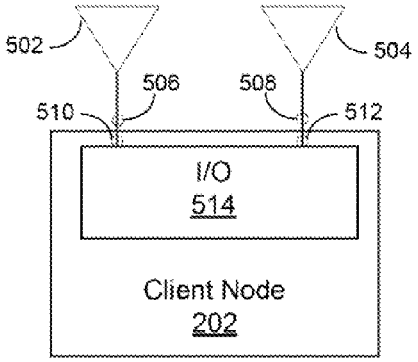
FIG. 5*a* is an illustration of a client node with multiple antennas.

Referring now to FIGS. 5-12, embodiments of the coupling compensation circuit of the present disclosure will now be described. FIG. 5 is a generalized illustration of a client node 202 comprising first antenna 502 and second antenna 504. The first and second antennas 502, 504 comprise first and second antenna ports 506 and 508 that are operably coupled to first and second input/output (I/O) ports 510 and 512, respectively, of an I/O circuit 514 in the client node 202.

As discussed hereinabove, a limitation in implementing multiple antennas in a client node 202 is the increased coupling that takes place between the antennas as the operating frequency becomes lower and/or as the client node becomes smaller. The mutual coupling between the antennas also has a negative impact on the correlation between the antennas, which directly impacts the overall system performance.

Figure 5B:
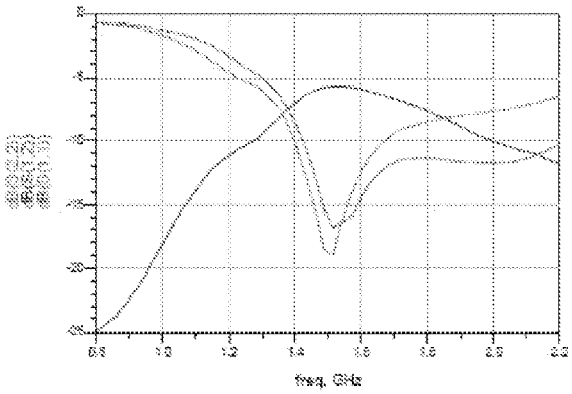
FIG. 5*b-c* are illustration of the response of a multi-antenna device without any coupling compensation and the envelope correlation without compensation.
Figure 5C:
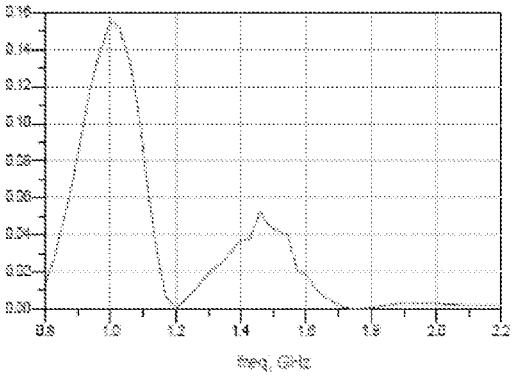

Those of skill in the art will appreciate that the advantages of the various embodiments of the coupling compensation circuit described herein can be implemented in systems comprising a wide range of frequencies, physical dimensions, and antenna configurations. For purposes of illustration, embodiments of the disclosure will sometimes be discussed in conjunction descriptions of experimental measurements conducted a using two-monopole printed antennas with separation of 0.25λ at 1.5 GHz. FIGS. 5*b-c* are graphical illustrations of S-parameters and envelope correlation corresponding to the response of a two antennas when coupled to the I/O circuit 514 without a coupling compensation circuit shown. As can be seen in FIG. 5*b*, mutual coupling between the antennas measures 6 dB at 1.5 GHz.

Figure 6:
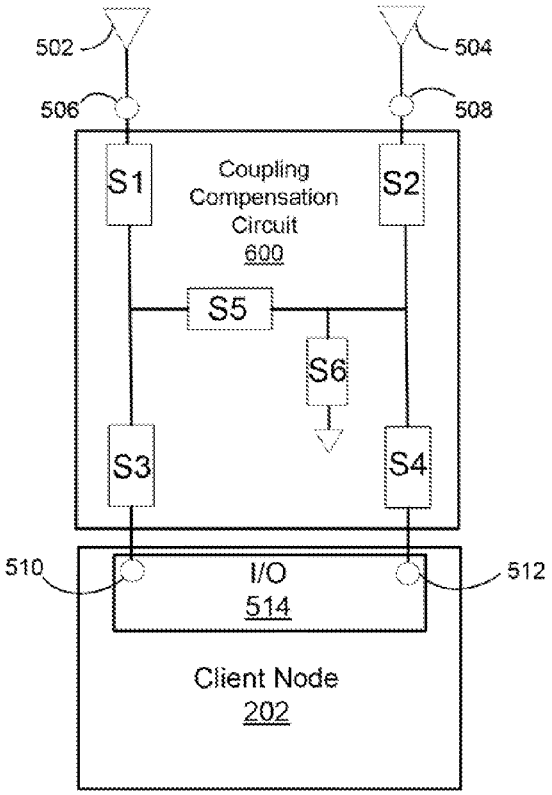
FIG. 6 is a general illustration of the components of a coupling compensation circuit in accordance with embodiments of the disclosure.

Various embodiments of the coupling compensation circuit are composed of up to six sections, as shown in FIG. 6, although the principles described herein are not limited to a specific number of sections. These sections comprise components that optimize scattering parameters (S-parameters) and, therefore, will sometimes be referred to as sections S1-S6 in the various embodiments described herein.

In the embodiment shown in FIG. 6, sections S1 and S2 are the main sections that control the mutual coupling level between the antenna ports 506 and 508 and the envelope correlation. Sections S3 and S4 are the main sections that provide the necessary impedance match between the optimized S5/S6 mutual coupling compensation and the antenna ports 510 and 512 in the I/O 514 of the RF front end of client node 202. The component of the six sections or a number of them can be fixed in their design or they can be dynamically tunable in real-time on the client node 202. Section S6 is terminated with ground on one end and is connected to Section S5 on the other end. This section provides an extra degree of freedom in controlling the coupling currents in the antennas' ports for small form factor practical implementations.

Figure 7:
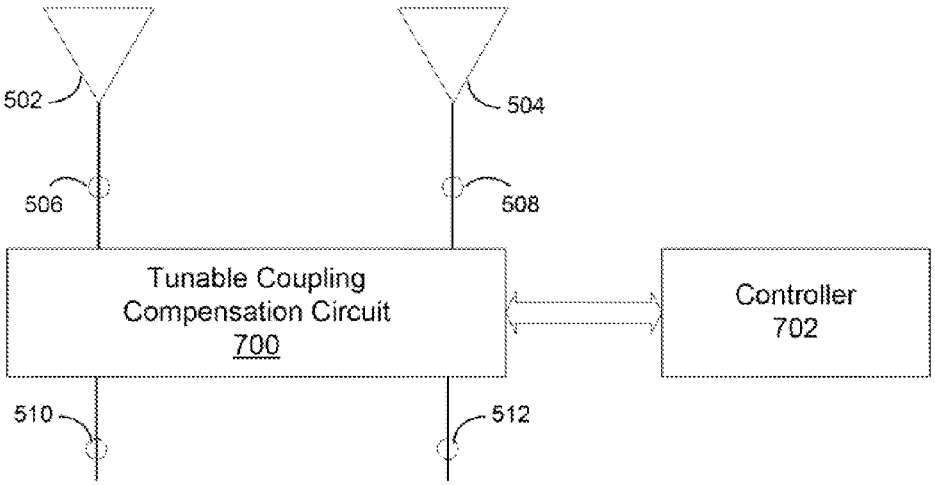
FIG. 7 is a general illustration of a tunable coupling compensation circuit in accordance with embodiments of the invention.

FIG. 7 shows an embodiment of a tunable coupling compensation circuit 700 having a controller 702 coupled thereto and operable to control the operating values of the components in the various S-sections in accordance with the present disclosure. This coupling compensation circuit and controller 702 can be implemented in a number of different configurations as described hereinbelow, using techniques known to those of skill in the art.

Figure 8A:
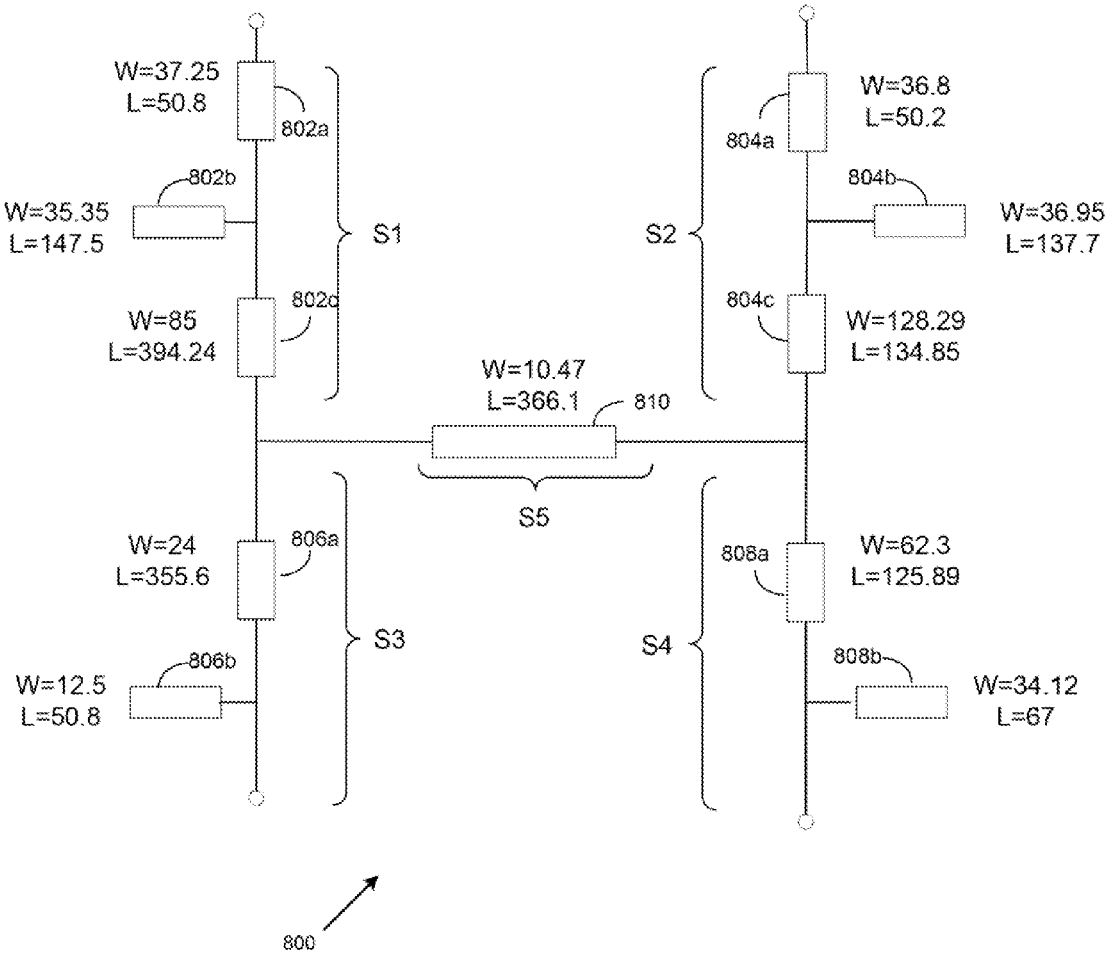
FIG. 8*a* is an illustration of a coupling compensation circuit comprising transmission line elements in accordance with embodiments of the disclosure.

In one embodiment, a coupling compensation circuit 800, shown in FIG. 8*a*, is implemented using only transmission lines. In the embodiments shown in this and other figures describing the use of transmission lines, those of skill in the art will understand that "W" and "L" refer to width and length dimensions denominated in millimeters. In the embodiment, shown in FIG. 8*a*, section S1 is comprised of the transmission line traces 802*a-c* and section S2 is comprised of the transmission line traces 804*a-c*, having the dimensions shown in FIG. 8*a*. Section S3 is comprised of transmission line traces 806*a-b* and Section S4 is comprised of transmission line traces 808 *a-b*. Section S5 is comprised of the transmission line trace 810.

Figure 8C:
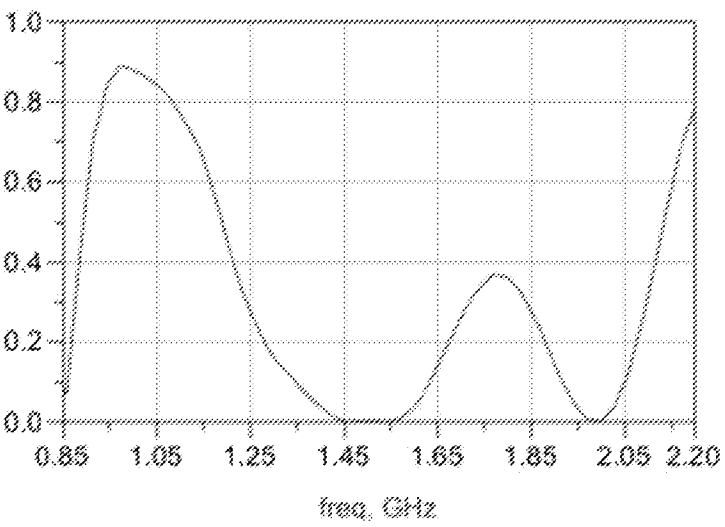
FIGS. 8*b-c* are graphical illustrations of scattering parameters (S-parameters) and envelope correlation corresponding to the response of multiple antennas when coupled to an embodiment of the coupling compensation circuit shown in FIG. 8*a;*
Figure 8B:
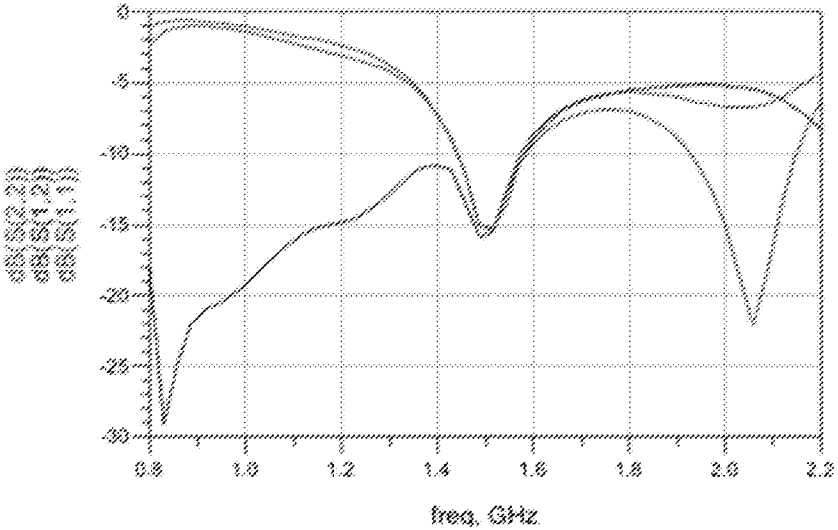

FIGS. 8*b* and 8*c* are graphical illustrations of S-parameters and envelope correlation corresponding to the response of multiple antennas when coupled to an embodiment of the coupling compensation circuit shown in FIG. 8*a*.

For a tunable implementation with the transmission lines in any of the embodiments described herein, switches (not shown) operable by the controller 702 can be used to switch parts of the respective transmission line in and out of the circuit changing its physical dimension(s) to change the tuning parameters of the circuit.

Figure 9A:
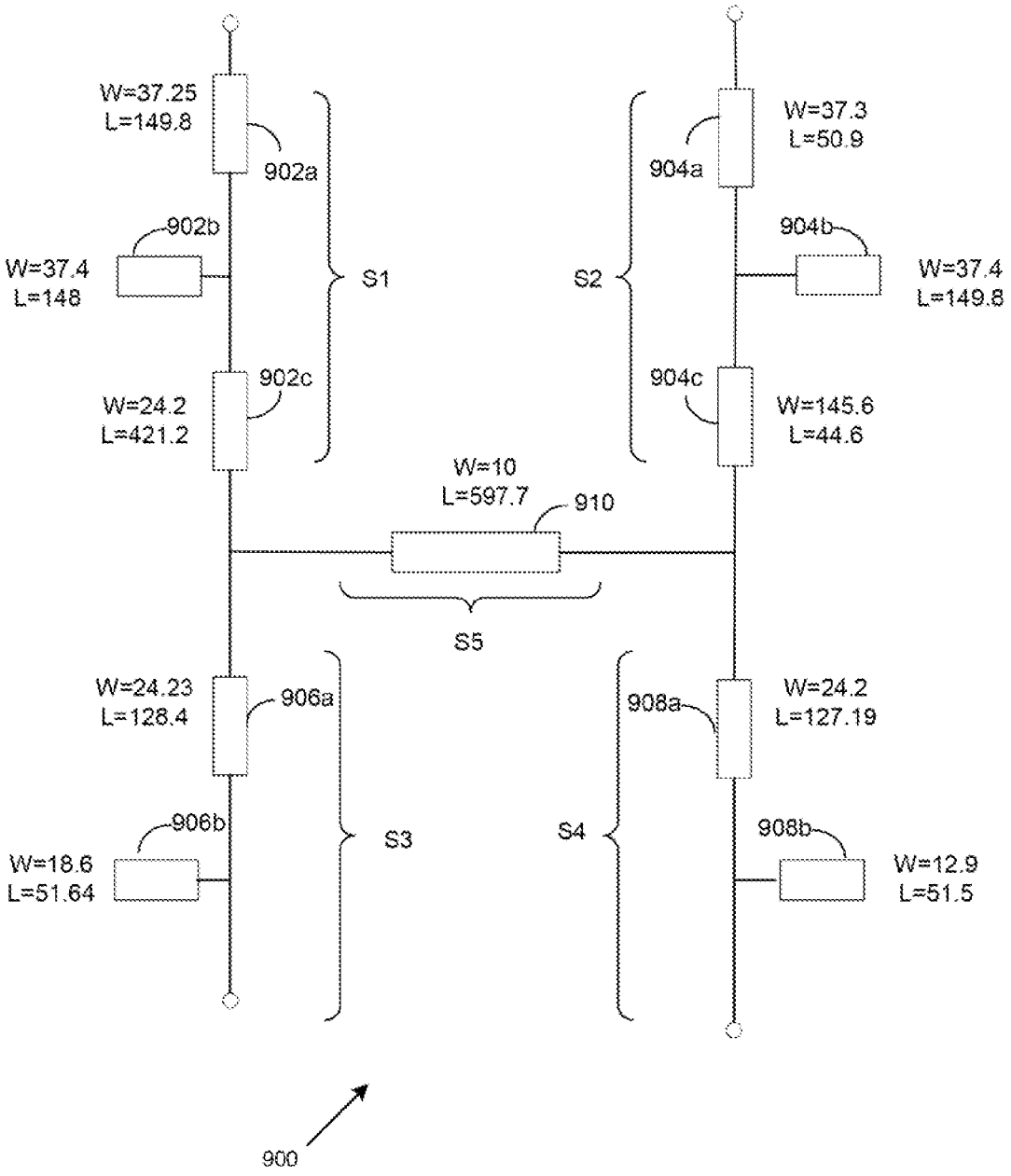
FIG. 9*a* is an illustration of a coupling compensation circuit comprising transmission line elements on an optimized substrate in accordance with embodiments of the disclosure.

FIG. 9*a* is an illustration of another embodiment of a coupling compensation circuit 900 using only transmission lines. In the embodiment shown in FIG. 9*a*, section S1 is comprised of the transmission line traces 902*a-c* and section S2 is comprised of the transmission line traces 904*a-c*. Section S3 is comprised of transmission line traces 906*a-b* and Section S4 is comprised of transmission line traces 908 *a-b*. Section S4 is comprised of transmission line trace 910.

Figure 9C:
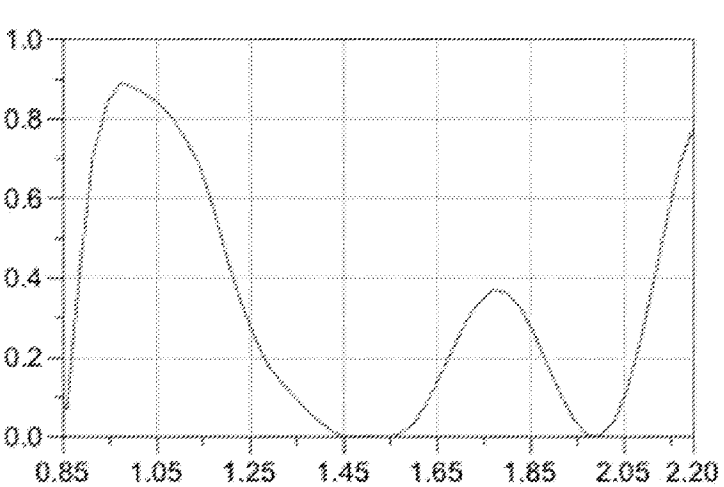
FIGS. 9*b-c* are graphical illustrations of S-parameters and envelope correlation corresponding to the response of multiple antennas when coupled to an embodiment of the coupling compensation circuit shown in FIG. 9*a;*
Figure 9B:
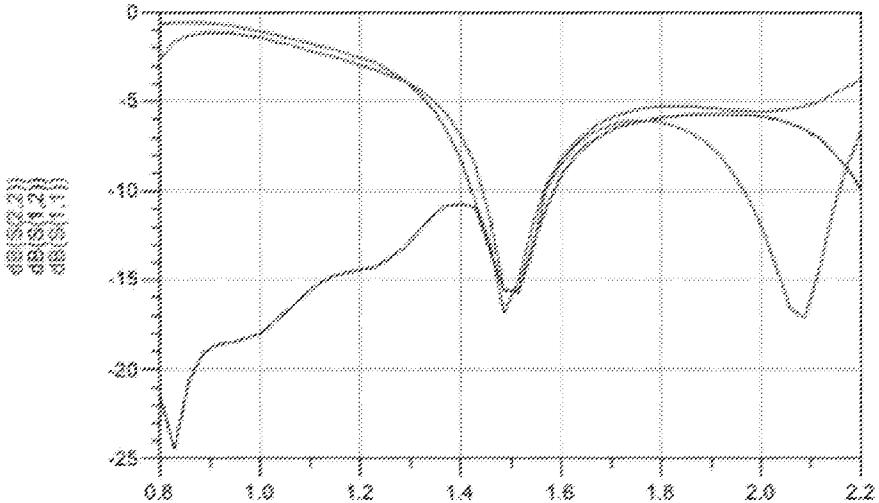

FIGS. 9*b* and 9*c* are graphical illustrations of S-parameters and envelope correlation corresponding to the response of multiple antennas when coupled to an embodiment of the coupling compensation circuit shown in FIG. 9*a*. In this implementation, the substrate material and height are used to add degrees of freedom to the implementation. The optimized results were achieved by fabricating the transmission line traces on a substrate with a slightly higher permitivity, i.e., 5 instead of the FR4 with permitivity of 4.4 for the embodiment shown in FIG. 8*a*. The optimized correlation results are shown in FIGS. 9*b-c*.

Figure 10A:
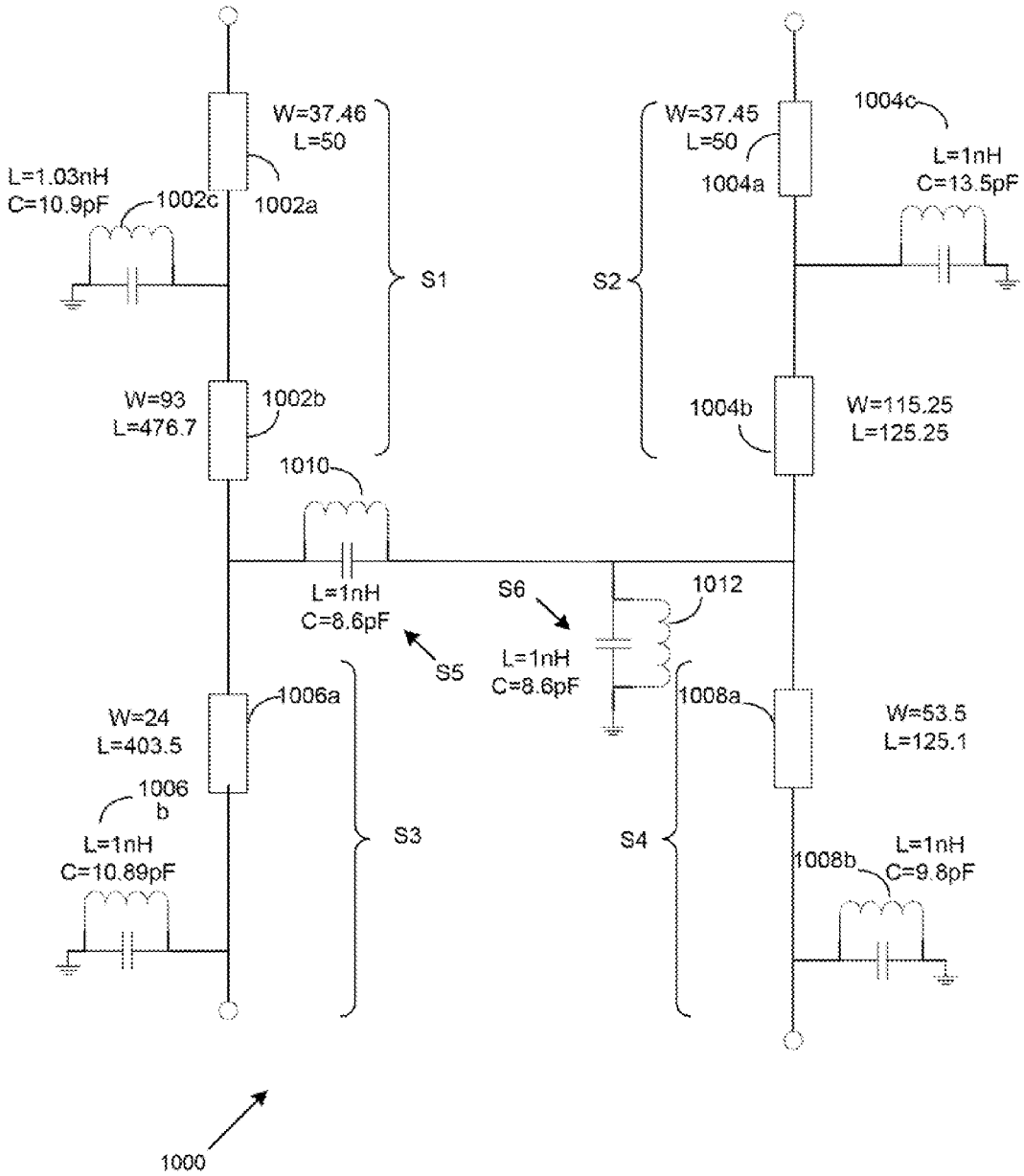
FIG. 10*a* is an illustration of a hybrid coupling compensation circuit comprising transmission line elements and lumped elements in accordance with embodiments of the disclosure.

FIG. 10*a* is an illustration of another embodiment of a coupling compensation circuit 1000 using a hybrid combination of transmission lines and lumped elements, i.e., inductors (L) and capacitors (C). In the embodiment shown in FIG. 10*a*, section S1 is comprised of the transmission line traces 1002*a-b* and LC circuit 1002*c* and section S2 is comprised of the transmission line traces 1004*a-b* and LC circuit 1004*c*. Section S3 is comprised of transmission line trace 1006*a* and LC circuit 1006*b*. Section S4 is comprised of transmission line trace 1008*a* and LC circuit 1008*b*. Section S5 is comprised of LC circuit 1010 and section S6 is comprised of LC circuit 1012. The transmission line traces and the inductors and capacitors in this embodiment have the dimensions and/or values shown in FIG. 10*a*.

Figure 10C:
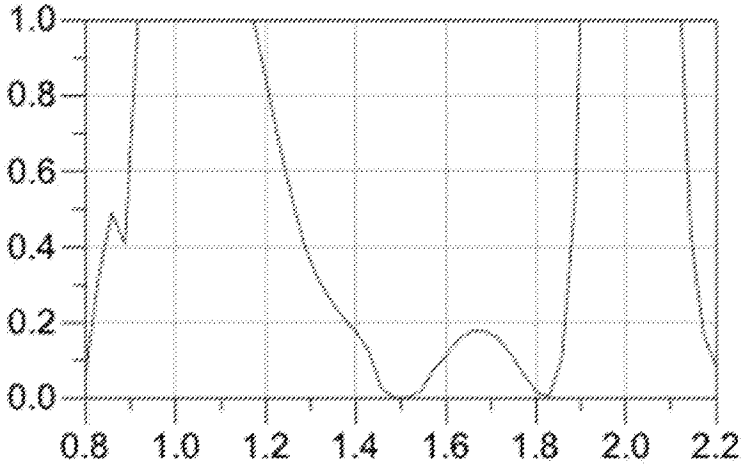
FIGS. 10*b-c* are graphical illustrations of S-parameters and envelope correlation corresponding to the response of multiple antennas when coupled to an embodiment of the hybrid coupling compensation circuit shown in FIG. 10*a*.
Figure 10B:
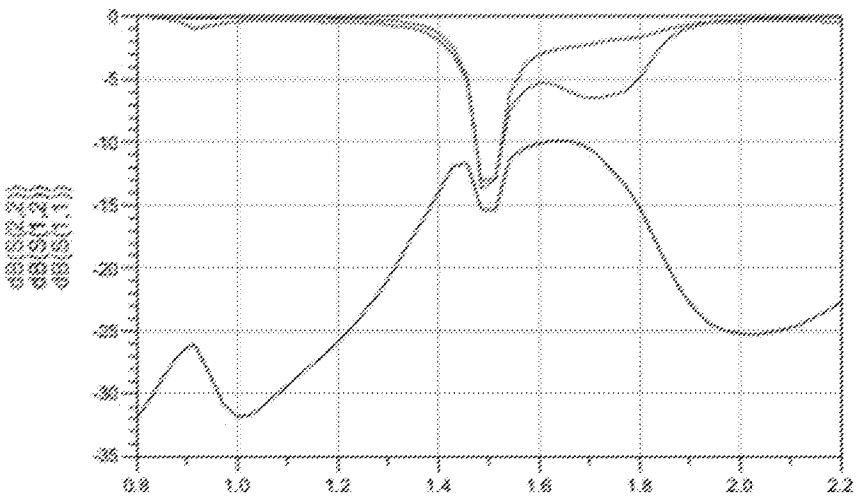

FIGS. 10*b* and 10*c* are graphical illustrations of S-parameters and envelope correlation corresponding to the response of multiple antennas when coupled to an embodiment of the coupling compensation circuit shown in FIG. 10*a*.

Figure 11A:
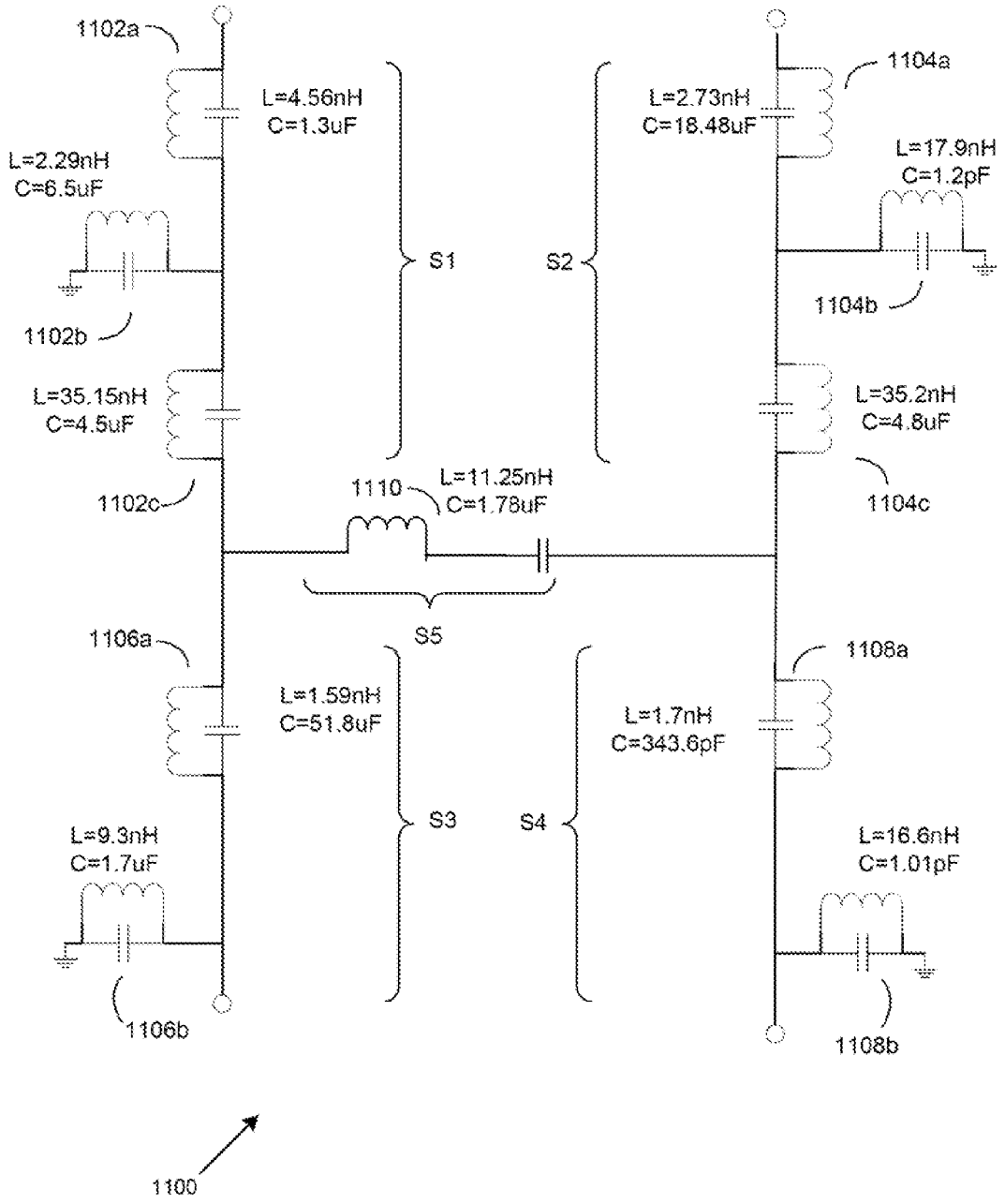
FIG. 11*a* is an illustration of a coupling compensation circuit comprising transmission line elements on an optimized substrate in accordance with embodiments of the disclosure.

FIG. 11*a* is an illustration of another embodiment of a coupling compensation circuit 1100 using only lumped elements. In the embodiment shown in FIG. 11*a*, section S1 is comprised of LC circuits 1102*a-c* and section S2 is comprised of LC circuits 1104*a-c*. Section S3 is comprised of LC circuits 1106*a-b* and Section S4 is comprised of LC circuits 1208*a-b*. Section S5 is comprised of LC circuit 1110.

Figure 11C:
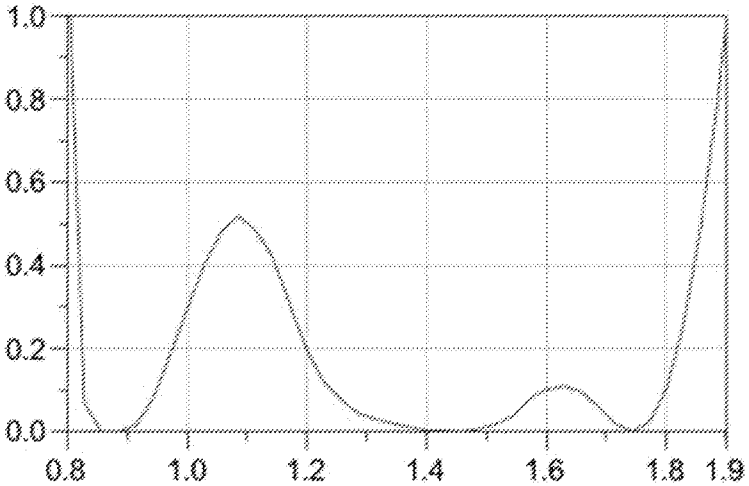
FIGS. 11*b-c* are graphical illustrations of S-parameters and envelope correlation corresponding to the response of multiple antennas when coupled to an embodiment of the coupling compensation circuit shown in FIG. 11*a;*
Figure 11B:
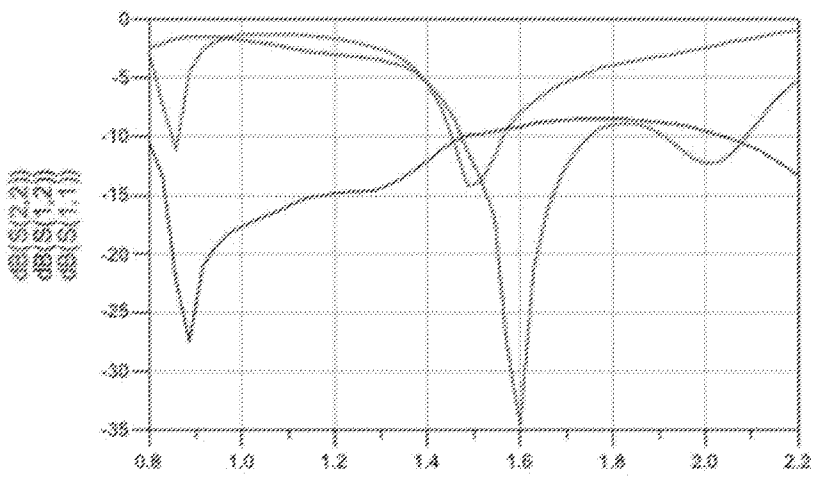

FIGS. 11*b* and 11*c* are graphical illustrations of S-parameters and envelope correlation corresponding to the response of multiple antennas when coupled to an embodiment of the coupling compensation circuit shown in FIG. 11*a*.

Figure 12A:
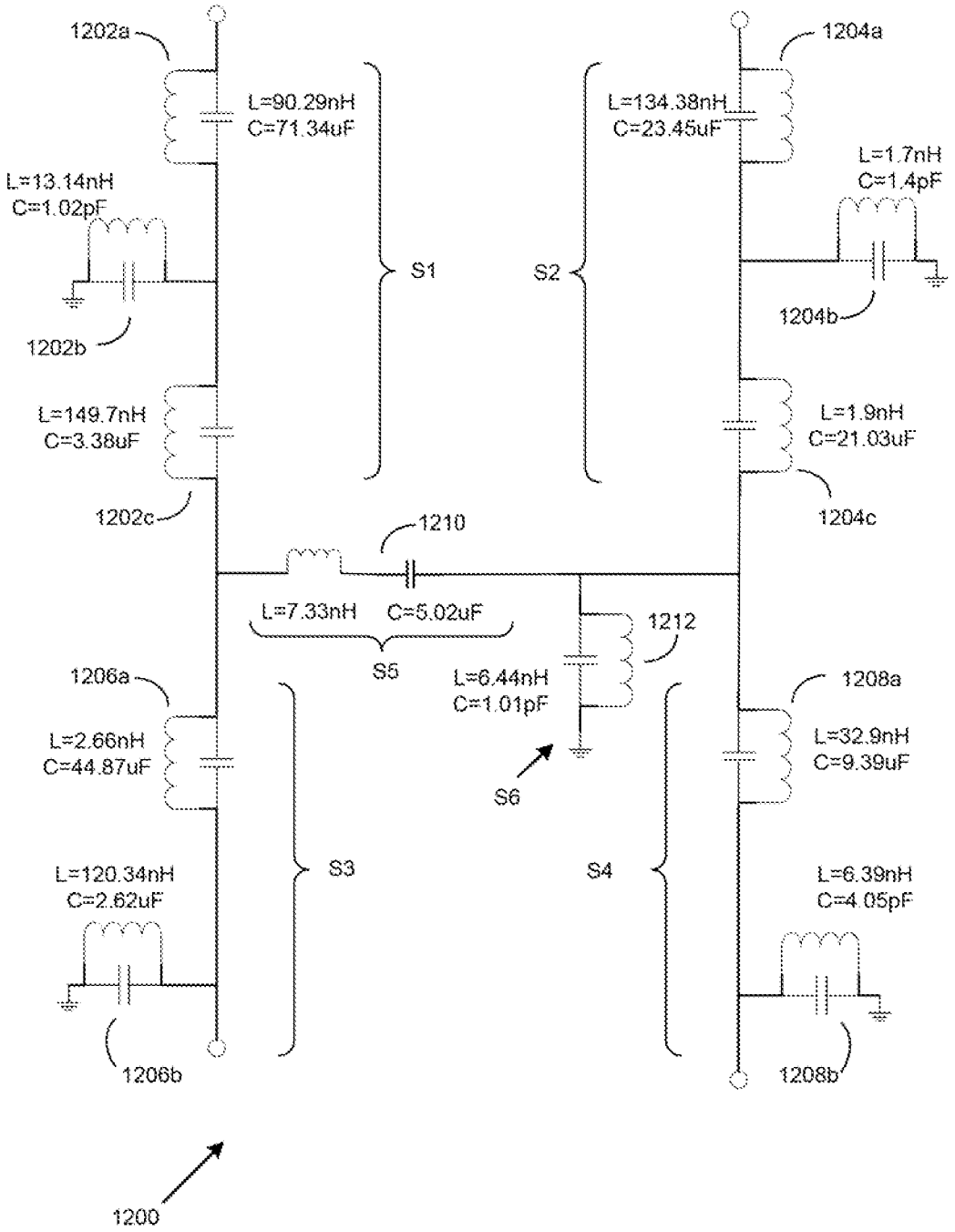
FIG. 12*a* is an illustration of a coupling compensation circuit comprising transmission line elements on an optimized substrate in accordance with embodiments of the disclosure.

FIG. 12*a* is an illustration of another embodiment of a coupling compensation circuit 1200 using only lumped elements. In the embodiment shown in FIG. 12*a*, section S1 is comprised of LC circuits 1202*a-c* and section S2 is comprised of LC circuits 1204*a-c*. Section S3 is comprised of LC circuits 1206*a-b* and Section S4 is comprised of LC circuits 1206*a-b*. Section S5 is comprised of LC circuit 1208 and section S6 is comprised of LC circuit 1210. In this embodiment and other embodiments comprising a sixth S-section, the performance of the mutual coupling compensation circuit is enhanced because of the extra degree of freedom provided by the sixth S-section.

Figure 12C:
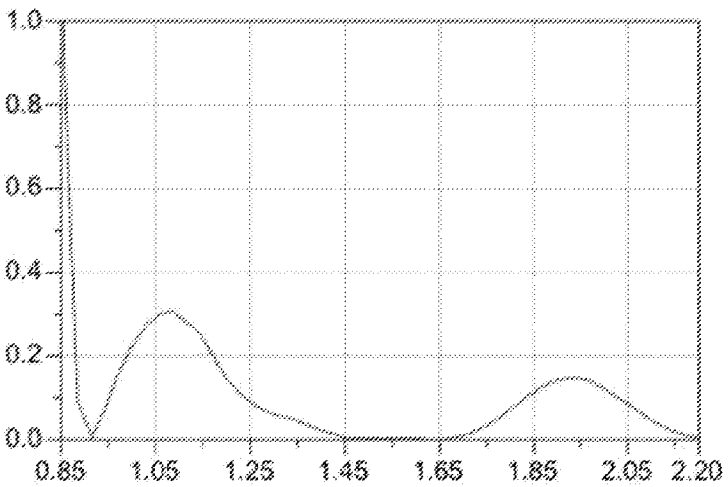
FIGS. 12*b-c* are graphical illustrations of S-parameters and envelope correlation corresponding to the response of multiple antennas when coupled to an embodiment of the coupling compensation circuit shown in FIG. 12*a*.
Figure 12B:
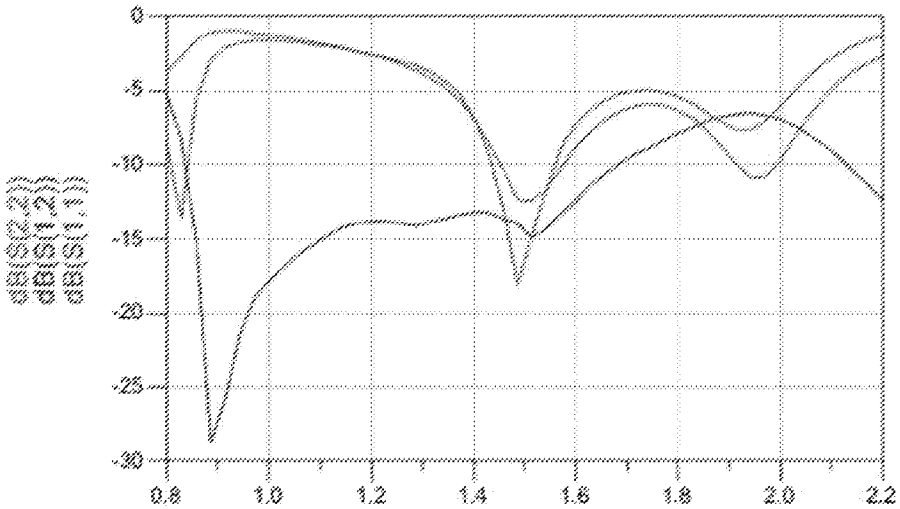

FIGS. 12*b* and 12*c* are graphical illustrations of S-parameters and envelope correlation corresponding to the response of multiple antennas when coupled to an embodiment of the coupling compensation circuit shown in FIG. 12*a*.

For a tunable implementation with the transmission lines in any of the embodiments described herein, switches can be used to switch parts of the respective transmission line in and out of the circuit changing its physical dimension(s) to change the tuning parameters of the circuit. Likewise the various inductors and capacitors in the embodiments described herein can be implemented using variable inductors and variable capacitors, using techniques known by those of skill in the art, to implement the various embodiments described herein.

Although the described exemplary embodiments disclosed herein are described with reference to devices and methods for manipulating the mutual coupling and the correlation between antennas on a handset without the need to change the physical distance between them or to change their orientation, the present invention is not necessarily limited to the example embodiments which illustrate inventive aspects of the present invention that are applicable to a wide variety of authentication algorithms. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

What is claimed is:

1. A communication device comprising:

a first antenna and a second antenna, having corresponding first antenna port and second antenna port respectively, the antenna ports operably coupled to respective first input/output (I/O) port and second I/O port;

a coupling compensation circuit comprised of independently configurable sections, the coupling compensation circuit coupled between the antenna ports and the I/O ports, wherein the sections are configured before operation to comprise:

first, second, third, fourth, fifth and sixth sections, each said section having a first end and a second end, the respective first ends of the first section and the second section coupled to the respective first antenna port and second antenna port;

the second end of the first section coupled to the first end of the fifth section and the first end of the third section;

the second end of the second section coupled to the second end of the fifth section and the second end of the sixth section and the second end of the second section further coupled to the first end of the fourth section;

the second end of the sixth section being terminated to ground;

the respective second ends of the third and fourth sections being coupled to the respective first I/O port and second I/O port;

the first section and the second section each being configured to control a mutual coupling level and envelope correlation between the antenna ports;

the fifth and the sixth sections configured to optimize the mutual coupling of said configured first section and configured second section; and the third section and the fourth section each being configured to provide an impedance match between the optimized fifth and sixth sections and the I/O ports, wherein adjustment of the sixth section provides an extra degree of freedom in controlling coupling currents in the antenna ports.

2. The communication device of claim 1, further including switch elements for switching respective parts of one or more of the sections in or out of the compensation circuit to control tuning of the compensation circuit in operation of the antennas.

3. The communication device of claim 1, wherein at least one of said first and second sections is tunable.

4. The communication device of claim 1, wherein said coupling compensation circuit uses a hybrid combination of transmission lines and lumped elements.

5. The communication device of claim 1, wherein said sixth section comprises an inductive and capacitive (LC) circuit.

6. The communication device of claim 1, wherein said coupling compensation circuit uses only lumped elements.

7. The communication device of claim 6, wherein said lumped elements comprises inductive and capacitive elements.

8. The communication device of claim 4, wherein at least one of said sections comprises printed transmission traces.

9. The communication device of claim 8, wherein said printed transmission traces are printed on an enhanced substrate.

10. The communication device of claim 8, wherein said transmission traces have a variable impedance.

11. The communication device of claim 8, wherein the impedance of said transmission traces is varied by changing the length of said traces.

12. The communication device of claim 8, wherein the impedance of said printed traces is varied by changing the dielectric constant of an enhanced substrate.

13. The communication device of claim 1, including a controller coupled to said compensation circuit for tuning at least one of said sections.

14. The communication device of claim 1, wherein said fifth section is coupled between a series connection formed of said first and third sections and said second and fourth sections.

* * * * *